United States Patent [19]

Ballu

[11] 3,966,092

[45] June 29, 1976

[54] MANUALLY OPERATED MAN-PORTABLE SPRAYER

[75] Inventor: Vincent Pierre Marie Ballu, Epernay, France

[73] Assignee: Tecnoma, Epernay, France

[22] Filed: Sept. 15, 1975

[21] Appl. No.: 613,234

[30] Foreign Application Priority Data

Sept. 17, 1974 France ..... 74.31341

[52] U.S. Cl. ..... 222/175; 239/153; 239/154; 239/331

[51] Int. Cl.[2] ..... B67D 5/64; B05B 9/08; B05B 11/00

[58] Field of Search ..... 222/175, 179; 239/331, 239/332, 333, 334, 152–154

[56] References Cited

FOREIGN PATENTS OR APPLICATIONS

| | | | |
|---|---|---|---|
| 137,030 | 4/1950 | Australia | 239/153 |
| 616,365 | 2/1961 | Italy | 239/153 |
| 23,541 | 1911 | United Kingdom | 239/152 |
| 1,136,513 | 12/1968 | United Kingdom | 239/154 |

*Primary Examiner*—Robert S. Ward, Jr.
*Attorney, Agent, or Firm*—Gordon W. Hueschen

[57] ABSTRACT

The invention relates to a manually operated man-portable sprayer comprising a reciprocating pump the body of which extends through the upper wall of the reservoir, through which it can be caused to slide by a side-mounted actuating lever, said pump being disposed centrally in relation to the reservoir. Force is transmitted from the actuating lever to the pump body by a stirrup-shaped two-branch connecting-rod having its top hingedly connected to the pump body and co-extensive therewith, and its two branches partially engaging into undercut reinforcing grooves formed in the reservoir wall on either side of and adjacent to the location of the pump body.

5 Claims, 1 Drawing Figure

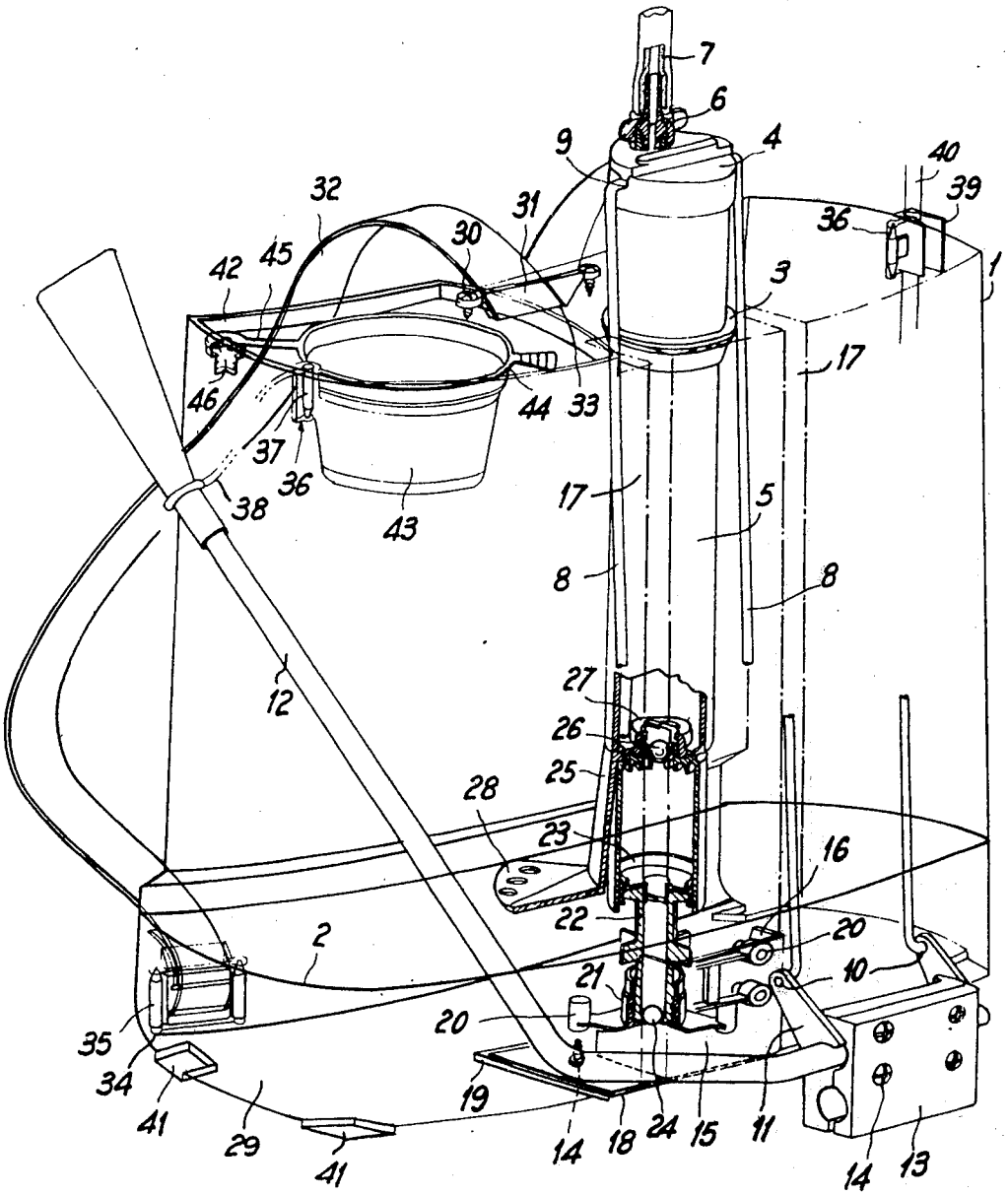
7
6
9
4
40
39
32
31
36
30
42
45
3
1
17
46
44
33
37
36
38
43
17
5
8
8
12
27
26
25
28
23
16
22
20
2
21
10
20
35
34
19
41
29
14
18
24
15
11
14
13
41

MANUALLY OPERATED MAN-PORTABLE SPRAYER

The present invention relates to sprayers of the kind carried on a man's back and operated by a side-lever which the carrier moves back and forth.

In his French patent No. 1,494,165, the Applicant described a sprayer of this kind having a reciprocating pump the cylindrical body of which dips into the reservoir, projects from the upper wall thereof, through which it is slidable responsively to the side-lever, and cooperates with a piston fixed to the bottom of the reservoir. The pump is arranged along the lateral wall of the reservoir, on the same side as the actuating lever, and therefore the forces between the lever and the pump body are transmitted by a beam-lever which is subjected to large bending loads.

The present invention has as its main object to overcome this disadvantage and to improve both the manner of operation and the robustness of the sprayer and at the same time reduce its weight and cost.

In a sprayer according to this invention, the pump is positioned in the central part of the sprayer reservoir, adjacent that wall which faces the wall to be applied against the carrier's back. The force exerted by the actuating lever is transmitted to the pump body through a stirrup-shaped two-branch connecting rod hingedly connected to the top of the pump body, coextensive with the axis thereof. The branches of the double connecting-rod engage partially into undercut reinforcing grooves formed in the reservoir wall adjacent the pump and on either side of the location thereof.

It is thereby possible to construct a sprayer the active components of which are well protected inside a reservoir which can be produced by injection-moulding, whereby the reinforcing grooves for accomodating the actuating connecting-rod branches can be integrally moulded.

This in turn makes it possible to provide efficiently, and at low cost, the mutual links between the actuating lever and the pump, body as well as the pump piston, by means of a box made of strong inexpensive sheet-metal and attached to the reservoir.

Lastly, the method of manufacturing the reservoir allows of embodying certain ingenious features for securing accessories like shoulder straps, clips, and so forth.

The description which follows with reference to the accompanying non-limitative examplary drawing will give a clear understanding of how the invention can be carried into practice.

The single FIGURE shows in perspective, with partial cutaway, a sprayer according to the invention.

In the embodiment illustrated in the drawing, the sprayer includes a reservoir 1 having a cross-section of substantially curvilinear rectangular shape, the lateral faces of which are all convex and either cylindrical or conical, with the exception of the face to be applied against the carrier's back, which face is concave.

The reservoir may be made of injection-moulded plastics, in two parts which are subsequently joined by hot-plate welding along the line 2 shown on the drawing.

The shape of the reservoir lends itself to low-cost manufacture of the injection moulds, by adding separate segments into a bore of diameter equal to the width of the reservoir.

The top of the reservoir has its central part formed with a circular hole 3 through which is slidable the cylindrical upper portion 4 of a vertically disposed pump-body 5 open at its lower end. Cylindrical portion 4 forms a pressure regulating air chamber and includes an outlet stub 6 provided with a union over which can be fitted a discharge pipe 7 for the ingredient to be sprayed. Pipe 7 is extended by a tube which dips down to the bottom of the air chamber whereby to provide a volume of air at the top of the pump body.

Pump body 5 can be set in reciprocating motion by a two-branch connecting-rod 8 which is pivotable, on the one hand, at 9 on a diametrical line of the bottom of cylindrical portion 4 and, on the other, at its free ends 10 in crankpins 11 fast with an actuating lever 12.

Lever 12, the centerline of which lies in the same plane, can be supported—on either side, depending on whether the operator is left-handed or right-handed—in a two-part block 13 secured by screws 14 to a box-like unit 15 having a U-shaped upper portion the flanges 16 of which engage respectively into grooves 17 which are formed in the tank on either side of the location of pump body 5 and inside which the branches 8 of the connecting rod can oscillate.

These two grooves can be formed by injection, it being possible to provide for their locations in the moulds at low cost. Moreover, they lend rigidity to the reservoir.

The lower portion 18 of box 15 is accomodated in a recess 19 formed in the bottom of the reservoir. The screws for securing the box are screwed into nuts buried in integrally injected bosses 20.

Those of bosses 20 which serve for securing lower portion 18 are fast with a tapped sleeve 21 which is elevated in relation to the reservoir bottom and into which screws the hollow rod 22 of a piston 23, over which the pump is leaktightly slidable. Rod 22 includes a suction valve 24 formed by a ball which cooperates with the lower end of the seat-forming rod.

Pump body 5 includes a wall 25 which bounds the top of the pumping chamber and which is provided with a discharge valve 26 which is likewise formed by a ball and which is restrained by a block 27 integrally injection-moulded with pump body 5. Externally, the latter is fast with an agitator 28 consisting of a sector-shaped plate formed with holes therein.

It will be appreciated that the assembly consisting of lever 12, bearing block 13, box 15, piston 23 and reservoir 1 is intimately united and that the loads applied locally to the reservoir base 29 are distributed over the entire body of the reservoir through the agency of the reinforcements provided by the two grooves 17 closely flanking the pump body 5.

Further, since actuation is effected by a compound connecting-rod, traction is exerted symmetrically and there are no rocking forces liable to engender unwanted friction between the pump body and the reservoir.

Recourse to injection moulding makes it possible to obtain all the necessary detail features in a single operation, and in particular the attachment points for screws 30 for securing a strip 31 for restraining the upper portion of shoulder-straps 32 in an injection-moulded integral slot 33, dumb-bell-shaped openings 34 into which the lower ends of the shoulder-straps 32 can be tightly restrained by means of appropriately shaped buckles 35 formed with slits through which said straps are threaded, as shown in the drawing halfdumb-bell-shaped openings 36 provided at the top of the reservoir and into one of which can be engaged a fastener 37 fixed to a cord 38 for restraining the actuating lever 12, while the other receives the fixture for securing a clip 39 for retaining the sprayer nozzle 40; and supporting pads 41 at the bottom of the reservoir.

The reservoir can be filled through a laterally placed opening in its upper face, surrounded by a funnel-shaped rim 42. This opening is fitted with a screen and can be closed with a cover 44. The latter is attached by a strip 45 to an air inlet valve 46 fitted into the upper reservoir wall, thus preventing its loss after it has been lifted off said opening. Valve 46 serves as a plug, whereby the reservoir can be inverted and emptied completely when required.

It goes without saying that changes and substitutions of parts may be made in the forms of embodiment hereinbefore described without departing from the scope of the invention.

I claim:

1. In a manually operated man-portable sprayer having a piston-type reciprocating pump the body of which extends through the upper wall of the reservoir, through which wall said body can be caused to slide by a side-mounted actuating lever, the pump being disposed centrally in relation to the reservoir, the improvement consisting in that force is transmitted from the actuating lever to the pump body through a stirrup-shaped two-branch connecting-rod which is hingedly connected to the top of the pump body and coextensive therewith and the two protected branches of which are operative within two reinforcement-forming grooves provided in that wall of the reservoir which is remote from the wall to be applied against the carrier's back, on either side of the location of the pump body.

2. A sprayer as claimed in claim 1, in which the actuating lever is supported in a reversible bearing-forming block fitted to the reservoir via an intermediate reinforcing box-like structure having a base engaging into the reservoir and lateral flanges engaging into said grooves, the pump piston being attached to said base.

3. A sprayer as claimed in claim 1, in which the reservoir is bounded by cylindrical or conical lateral surfaces for facilitating its manufacture by injection moulding.

4. A sprayer as claimed in claim 3, in which the filling orifice may be closed by a cover attached to the reservoir by a strip, said strip being attached to a pipe forming an air inlet valve and a drain pipe.

5. A sprayer as claimed in claim 1, in which integrally injection-moulded openings or recesses are formed therein for fitting such accessories as shoulder-straps and clips.

* * * * *